US005943925A

United States Patent [19]

Huang

[11] Patent Number: 5,943,925

[45] Date of Patent: Aug. 31, 1999

[54] TOOL HAVING A FOLDABLE STRUCTURE

[76] Inventor: Yung Hsu Huang, No. 10, Lane 38, Li Der Street, Taiping City, Taichung, Hsien, Taiwan

[21] Appl. No.: 08/988,763

[22] Filed: Dec. 11, 1997

[51] Int. Cl.[6] ..... B25B 23/16

[52] U.S. Cl. ..... 81/177.2; 81/177.1; 81/177.8; 81/177.6; 81/177.7

[58] Field of Search ..... 81/177.1, 177.8, 81/177.2, 177.6, 177.7; 403/97, 96, 93, 92, 91

[56] References Cited

U.S. PATENT DOCUMENTS

| | | | |
|---|---|---|---|
| 1,431,389 | 10/1922 | Frisz | 81/177.7 |
| 1,835,315 | 12/1931 | McLay | 81/177.9 |
| 2,627,330 | 2/1953 | Gantz | 192/43.1 |
| 3,270,597 | 9/1966 | Neff et al. | 81/177.9 |
| 3,550,486 | 12/1970 | Edwards | 81/125 |
| 3,996,821 | 12/1976 | Murray | 81/177 |
| 5,280,740 | 1/1994 | Ernst | 81/177.7 |
| 5,836,223 | 11/1998 | Lin | 81/436 |

*Primary Examiner*—David A. Scherbel
*Assistant Examiner*—Philip J. Hoffmann

[57] ABSTRACT

A tool includes a coupler pivotally coupled between a driving stem and a handle. The coupler may be selectively secured to the driving stem at any suitable angular position, and the handle may also be selectively secured to the coupler at any suitable angular position, such that the handle may be folded to engage with the driving stem for forming a compact folding structure. The coupler and the handle each includes a number of teeth, the latch includes a number of teeth for being biased to engage with that of the coupler and the handle.

7 Claims, 5 Drawing Sheets

TOOL HAVING A FOLDABLE STRUCTURE

BACKGROUND OF THE INVENTION

1. Field of the Invention

The present invention relates to a tool, and more particularly to a tool having a foldable structure.

2. Description of the Prior Art

Typical tools comprise a handle that may be folded to a perpendicular position relative to the tool body and may not be folded to a compact folding structure.

The present invention has arisen to mitigate and/or obviate the afore-described disadvantages of the conventional tools.

SUMMARY OF THE INVENTION

The primary objective of the present invention is to provide a tool which may be folded to a compact configuration which is excellent for carrying and transportation purposes.

In accordance with one aspect of the invention, there is provided a tool comprising a driving stem including a first end having an engaging hole and including a second end, a coupler including a first end pivotally coupled to the second end of the driving stem and including a second end, a handle including a first end pivotally coupled to the second end of the coupler and including a second end, means for selectively securing the coupler to the driving stem at an angular position, and means for selectively securing the handle to the coupler at an angular position. The handle is allowed to be folded to engage with the driving stem for forming a compact folding configuration.

A sleeve is rotatably engaged on the driving stem for allowing the driving stem to be rotated relative to the sleeve when the sleeve is held in place.

The handle includes a hand grip secured to the second end of the handle. The handle includes a bracket pivotally secured to the second end of the handle at a pivot shaft and having a puncture, the hand grip includes a rod rotatably engaged in the puncture of the bracket for allowing the hand grip to be rotated about the rod.

The selectively securing means for the coupler and the driving stem includes a latch engaged through the second end of the driving stem and the first end of the coupler, the first end of the coupler includes an opening having a plurality of teeth, the latch includes a plurality of teeth for engaging with the teeth of the coupler and for positioning the coupler to the driving stem. A spring biasing means is further provided for biasing the teeth of the latch to engage with the teeth of the coupler.

The selectively securing means for the coupler and the handle includes a latch engaged through the second end of the coupler and the first end of the handle, the first end of the handle includes an opening having a plurality of teeth, the latch includes a plurality of teeth for engaging with the teeth of the handle and for positioning the handle to the coupler. A spring biasing means is further provided for biasing the teeth of the latch to engage with the teeth of the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
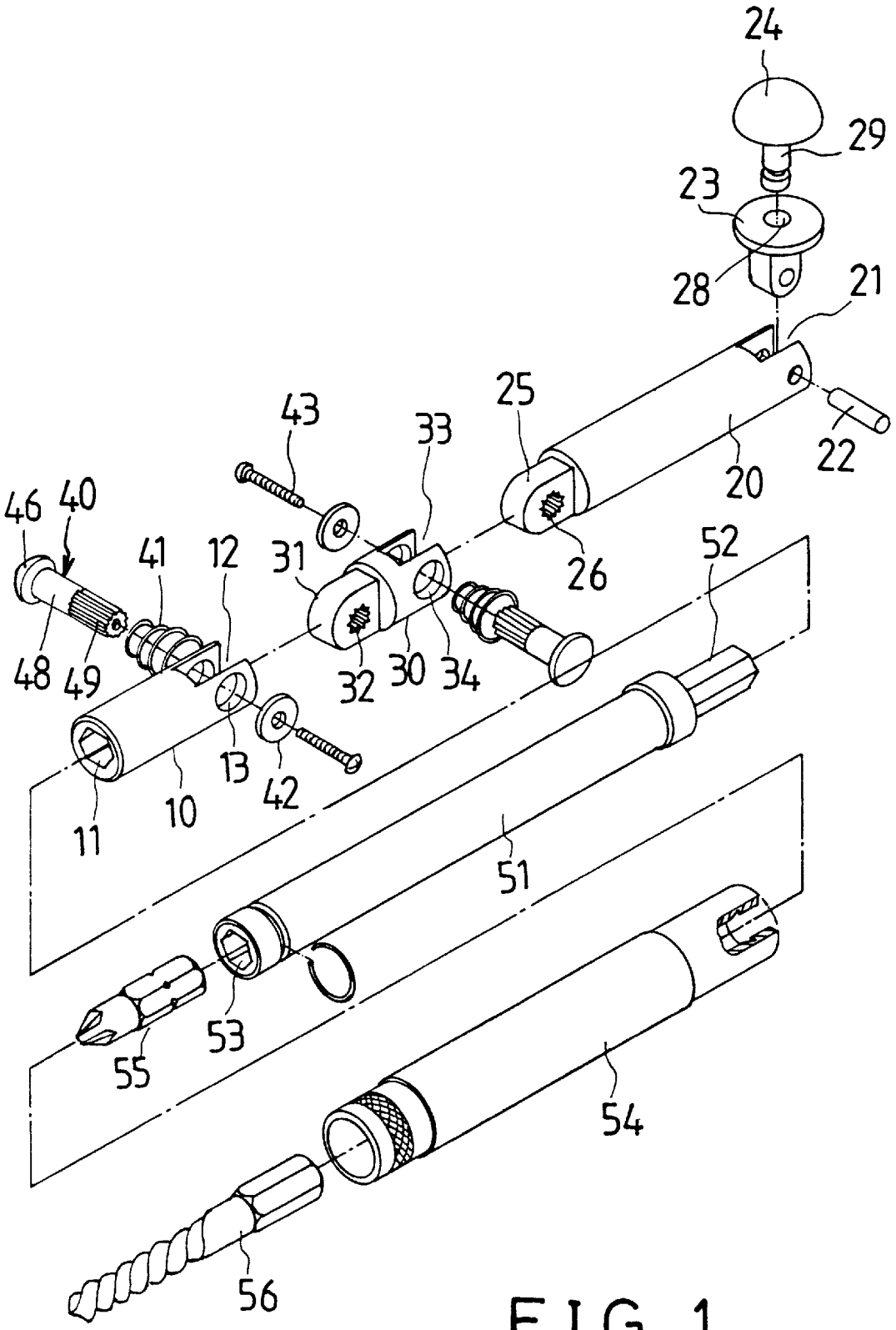
FIG. 1 is an exploded view of a tool in accordance with the present invention.
Figure 2:
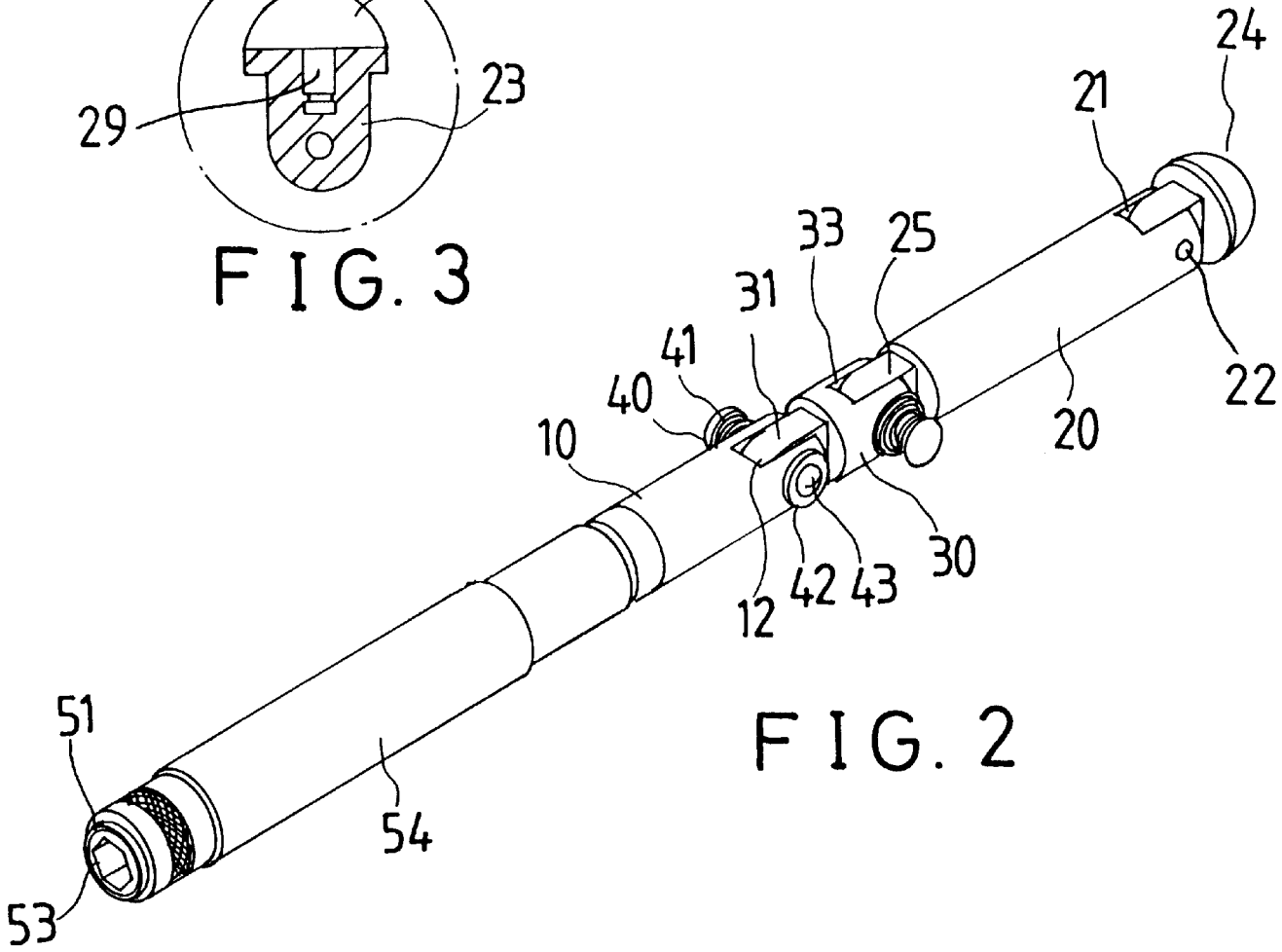
FIG. 2 is a perspective view of the tool.
Figure 3:
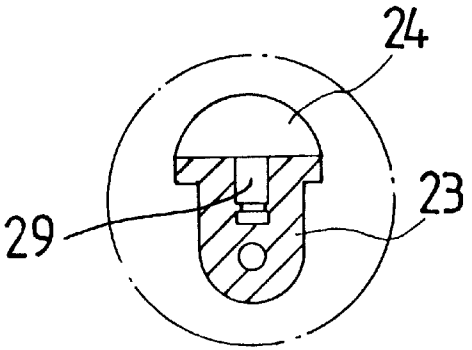
FIG. 3 is an enlarged partial cross sectional view of a hand grip.

Referring to the drawings, and initially to FIGS. 1–3, a tool in accordance with the present invention comprises a driving stem 10 including an engaging hole 11 formed in one end for engaging with the fastener 55 or the drilling tool bit 56 or the stud 52 of an extension 51. The driving stem 10 includes a notch 12 and two holes 13 formed in the other end. A coupler 30 includes an ear 31 extended from one end and rotatably engaged in the notch 12 of the driving stem 10 and includes a notch 33 and two holes 34 formed in the other end. A handle 20 includes a flange 25 extended from one end and rotatably engaged in the notch 33 of the coupler 30 and includes a notch 21 formed in the other end. The ear 31 and the flange 25 each includes an opening 32, 26 having a number of teeth formed in the inner peripheral portion. A bracket 23 is rotatably secured in the notch 21 of the handle 20 at a pivot shaft 22 and includes a puncture 28 for rotatably engaging with a rod 29 of a hand grip 24 and for allowing the hand grip 24 to be rotated about the rod 29.

Figure 4:
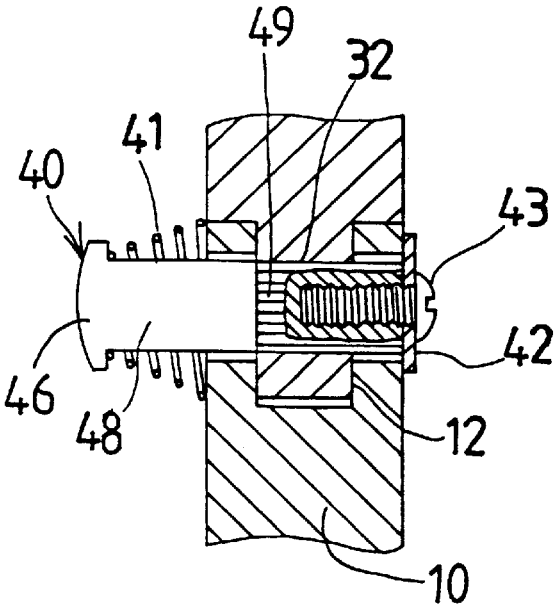
FIGS. 4 and 5 are enlarged partial cross sectional views illustrating the operation of the angular adjusting mechanism.
Figure 5:
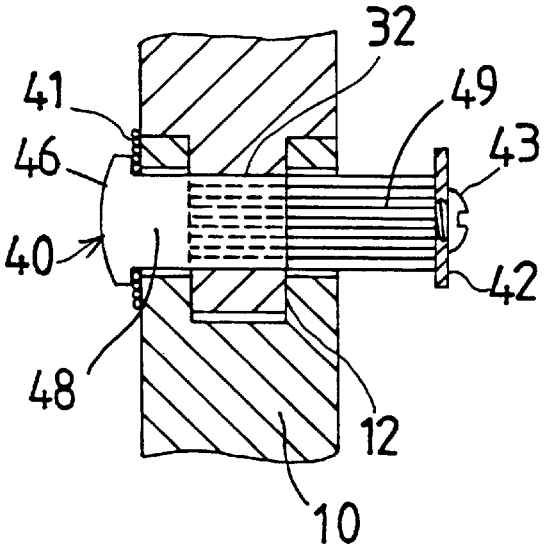

A latch 40 is engaged through the holes 13 of the driving stem 10 and engaged through the opening 32 of the coupler 30 for pivotally coupling the coupler 30 to the driving stem 10. A disc 42 is secured to one end of the latch 40 by a fastener 43 and is engageable with the driving stem 10 (FIGS. 4, 5) for preventing the latch 40 from being disengaged from the driving stem 10. The latch 40 includes a head 46 formed on the other end and includes a section 48 having no teeth formed thereon for allowing the coupler 30 to be rotated relative to the driving stem 10 (FIG. 5) and includes a number of teeth 49 for engaging with that of the coupler 30 and for positioning the coupler 30 to the driving stem 10 at any suitable and selected angular position (FIG. 4). A spring 41 is engaged between the driving stem 10 and the head 46 for biasing the teeth 49 of the latch 40 to engage with that of the coupler 30. Similarly, another latch 40 may pivotally couple the handle 20 to the coupler 30 and may position the handle 20 to the coupler 30 at any selected angular position.

Figure 6:
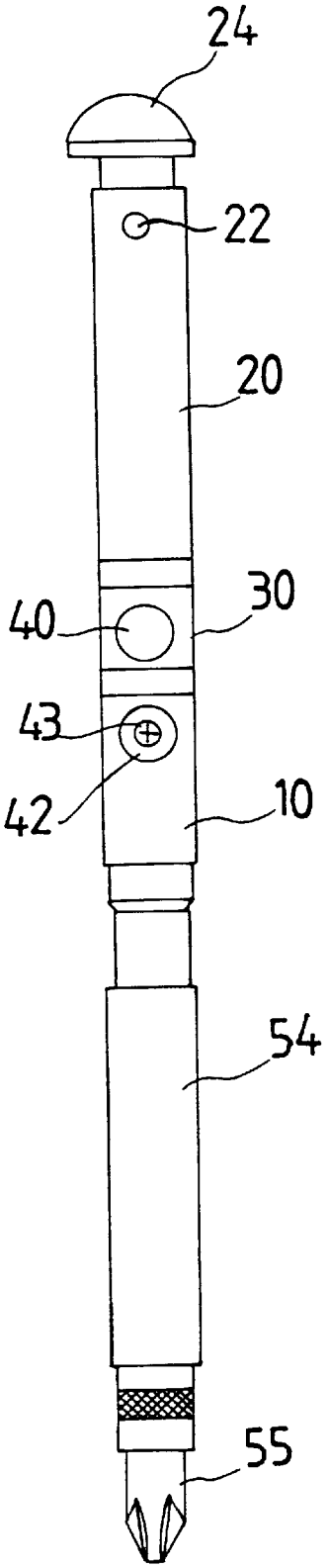
FIGS. 6, 7, 8 are plane views illustrating the operation of the tool.
Figure 7:
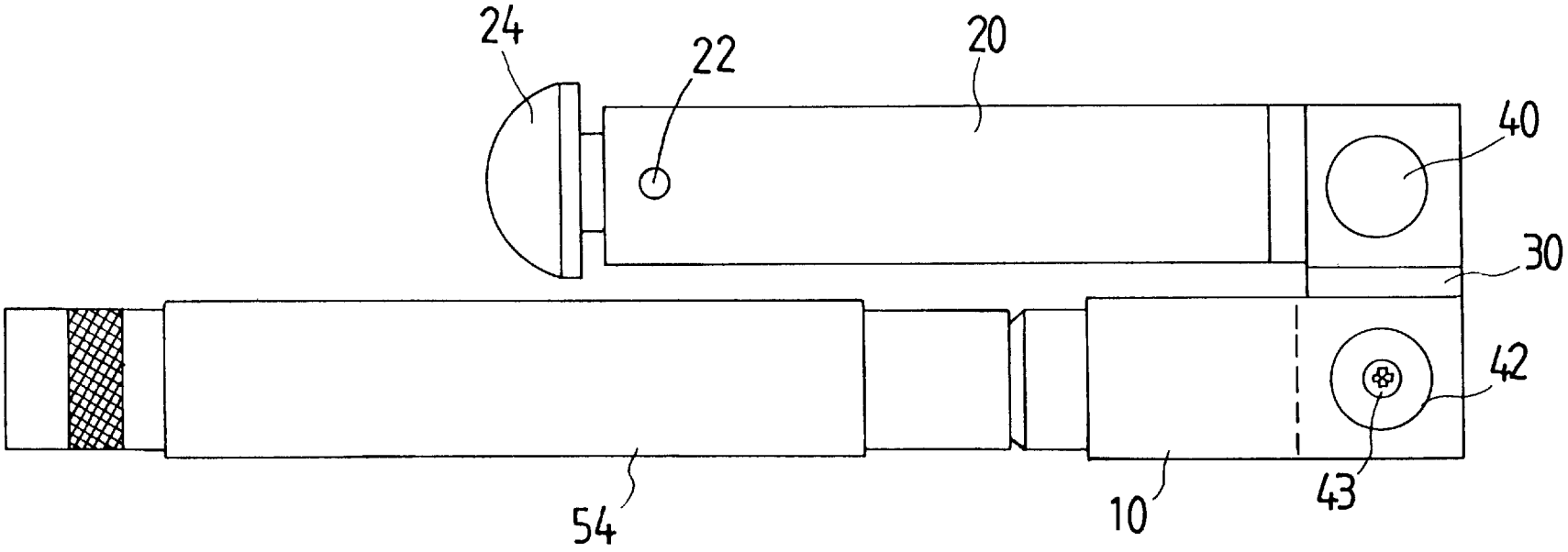
Figure 8:
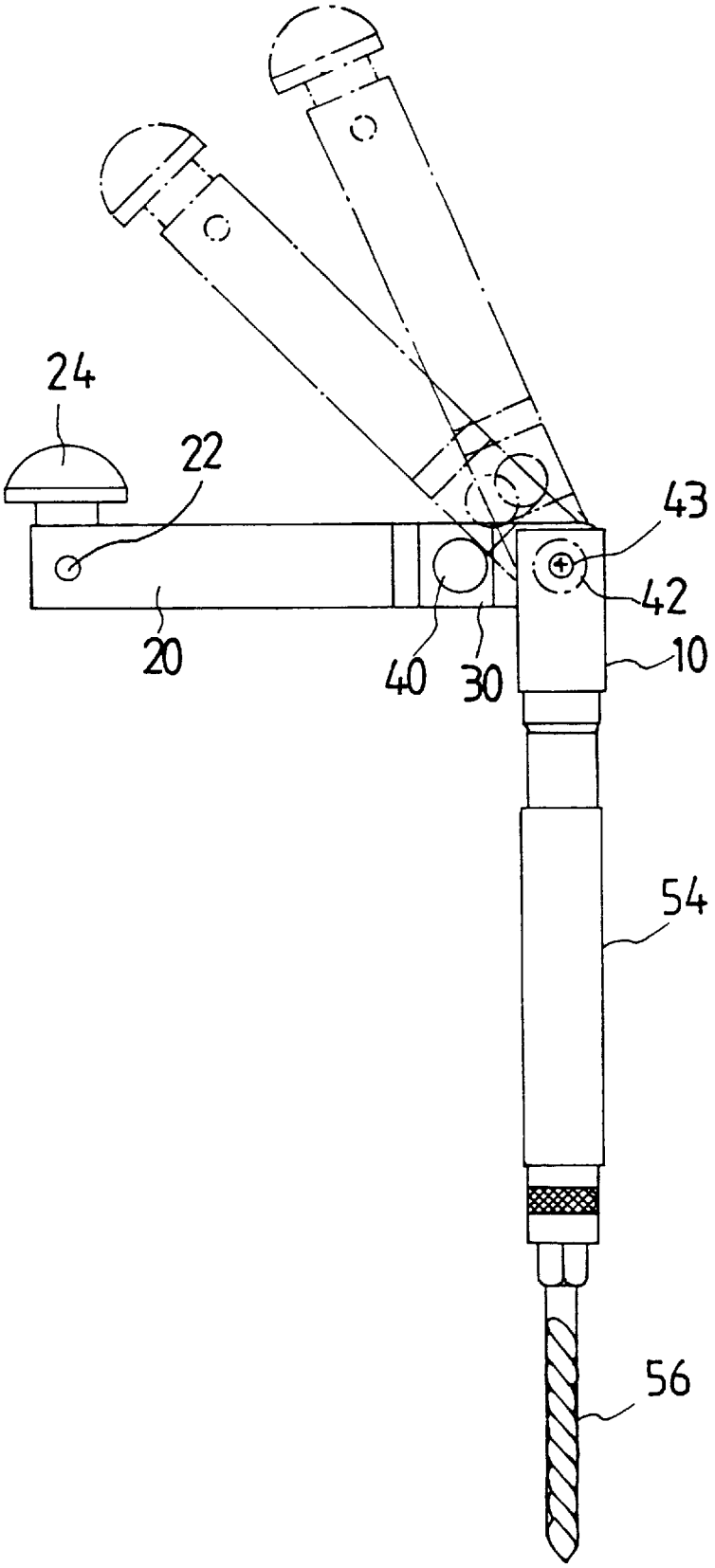

In operation, as shown in FIGS. 2 and 6–8, the stud 52 of the extension 51 may be engaged with the engaging hole 11 of the driving stem 10 so as to be driven by the driving stem 10. The extension 51 includes an engaging hole 53 formed in the other end for engaging with the tool bits 55, 56. A sleeve 54 is rotatably engaged on the extension 51. The user may hold the sleeve 54 for allowing the extension 51 to be rotatable relative to the sleeve 54 and for allowing the tool bits 55, 56 to be easily rotated. As shown in FIGS. 2 and 6, the extension 51 and the driving stem 10 and the coupler 30 and the handle 20 may be arranged in line such that the tool may be used as a typical screw driver or wrench. As shown in FIG. 7, the handle 20 may be folded to engage with the driving stem 10 and may be folded to a compact configuration that is excellent for carrying and transportation purposes. As shown in FIG. 8, the handle 20 may be rotated relative to the driving stem 10 and/or the extension 51 to any suitable angular position such that the tool bit or the drilling tool bit 56 may be easily rotated by the handle 20 and/or the hand grip 24 when the user hold the sleeve 54 in place.

Alternatively, the extension 51 and the driving stem 10 may be solidly secured together as an integral driving stem onto which the sleeve 54 is rotatably engaged.

Accordingly, the tool in accordance with the present invention may be folded to a compact configuration which is excellent for carrying and transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a driving stem including a first end having an engaging hole and including a second end, a sleeve rotatable engaged on said driving stem for allowing said driving stem to be rotated relative to said sleeve when said sleeve is held in place, a coupler including a first end pivotally coupled to said second end of said driving stem and including a second end, a handle including a first end pivotally coupled to said second end of said coupler and including a second end, means for selectively securing said coupler to said driving stem at an angular position, and means for selectively securing said handle to said coupler at an angular position, said handle being allowed to be folded to engage with said driving stem for forming a compact folding configuration.

2. The tool according to claim 1, wherein said handle further includes a hand grip secured to said second end of said handle.

3. A tool comprising:

a driving stem including a first end having an engaging hole and including a second end, a coupler including a first end pivotally coupled to said second end of said driving stem and including a second end, a handle including a first end pivotally coupled to said second end of said coupler and including a second end having a hand grip secured thereon, said handle including a bracket pivotally secured to said second end of said handle at a pivot shaft and having a puncture, said hand grip including a rod rotatably engaged in said puncture of said bracket for allowing said hand grip to be rotated about said rod, means for selectively securing said coupler to said driving stem at an angular position, and means for selectively securing said handle to said coupler at an angular position, said handle being allowed to be folded to engage with said driving stem for forming a compact folding configuration.

4. A tool comprising:

a driving stem including a first end having an engaging hole and including a second end, a coupler including a first end pivotally coupled to said second end of said driving stem and including a second end, a handle including a first end pivotally coupled to said second end of said coupler and including a second end, means for selectively securing said coupler to said driving stem at an angular position, and said selectively securing means for said coupler and said driving stem including a latch engaged through said second end of said driving stem and said first end of said coupler, said first end of said coupler including an opening having a plurality of teeth, said latch including a plurality of teeth for engaging with said teeth of said coupler and for positioning said coupler to said driving stem, and means for selectively securing said handle to said coupler at an angular position, said handle being allowed to be folded to engage with said driving stem for forming a compact folding configuration.

5. The tool according to claim 4 further comprising means for biasing said teeth of said latch to engage with said teeth of said coupler.

6. A tool comprising:

a driving stem including a first end having an engaging hole and including a second end, a coupler including a first end pivotally coupled to said second end of said driving stem and including a second end, a handle including a first end pivotally coupled to said second end of said coupler and including a second end, means for selectively securing said coupler to said driving stem at an angular position, and means for selectively securing said handle to said coupler at an angular position, said selectively securing means for said coupler and said handle including a latch engaged through said second end of said coupler and said first end of said handle, said first end of said handle including an opening having a plurality of teeth, said latch including a plurality of teeth for engaging with said teeth of said handle and for positioning said handle to said coupler, said handle being allowed to be folded to engage with said driving stem for forming a compact folding configuration.

7. The tool according to claim 6 further comprising means for biasing said teeth of said latch to engage with said teeth of said handle.

* * * * *